United States Patent [19]

Mondini et al.

[11] Patent Number: 5,038,441

[45] Date of Patent: Aug. 13, 1991

[54] COMBING MACHINE HAVING APPARATUS FOR CHANGING LAP ROLLS

[75] Inventors: Gian-Carlo Mondini; Hans-Ulrich Eichenberger, both of Winterthur, Switzerland

[73] Assignee: Rieter Machine Works Limited, Winterthur, Switzerland

[21] Appl. No.: 529,514

[22] Filed: May 29, 1990

[30] Foreign Application Priority Data

Jun. 1, 1989 [CH] Switzerland ..... 02067/89

[51] Int. Cl.[5] ..... D01G 19/08

[52] U.S. Cl. ..... 19/225; 19/115 R

[58] Field of Search ..... 19/97.5, 105, 115 R, 19/225, 65 A

[56] References Cited

U.S. PATENT DOCUMENTS

| | | | |
|---|---|---|---|
| 2,559,074 | 7/1951 | Hinson | 19/115 |
| 3,388,432 | 6/1968 | Saikawa et al. | 19/115 R |
| 3,440,688 | 4/1969 | Yamamoto et al. | 19/115 R |
| 4,528,721 | 7/1985 | Hera | 19/115 R X |
| 4,890,358 | 1/1990 | Marzoli | 19/115 R |

FOREIGN PATENT DOCUMENTS

| | | |
|---|---|---|
| 1283718 | 11/1968 | Fed. Rep. of Germany . |
| 2434898 | 6/1978 | Fed. Rep. of Germany . |
| 890150 | 1/1944 | France . |
| 2401593 | 3/1979 | France . |
| 572529 | 2/1976 | Switzerland . |

*Primary Examiner*—W. C. Reynolds
*Assistant Examiner*—John J. Calvert
*Attorney, Agent, or Firm*—Sandler, Greenblum & Bernstein

[57] ABSTRACT

Two lap slivers lying one on top of the other are continuously fed to the combing tools in a plurality of combing heads of a combing machine. The first lap sliver comes from a first lap roll carried by a rear carrier device, and runs over a front carrier device. A second lap roll is carried on this, from which the second lap sliver emanates. A detector determines when the end of the lap sliver from the first lap roll is running out in one of the combing heads. A control unit then executes a lap roll change on several combing heads simultaneously as follows: The end of the first lap sliver is severed to the same length in all the combing heads. The cut-off pieces of the lap slivers and the winding tubes of the first lap rolls are removed. The second lap rolls are rolled on to the rear carrier devices. New lap rolls are so placed on the front carrier devices that the start of the lap sliver on these new rolls is aligned with the end of the first lap sliver. In this way, the lap roll change can be executed completely automatically and without stopping the machine.

13 Claims, 2 Drawing Sheets

COMBING MACHINE HAVING APPARATUS FOR CHANGING LAP ROLLS

BACKGROUND OF THE INVENTION

The invention relates to a combing machine having a plurality of combing heads, each combing head including a rear carrier device for a first lap roll, with at least one first lap roller which can be driven, and a front carrier device for a second lap roll, with at least one second lap roller which can be driven, and each combing head having associated therewith a conveying device for placing lap rolls on the front carrier device.

A combing machine with a single combing head of the type mentioned is described in published German patent application no. 24 34 898. When the lap sliver is completely unrolled from the first lap roll, then the empty winding tube from this is removed manually, and the second lap roll is rolled from the front carrier device to the rear carrier device. Then the conveying device is actuated, so that a new lap roll is placed on the front carrier device (or on the lap sliver from the second lap roll now running over the first carrier device).

SUMMARY OF THE INVENTION

The object of the invention is to improve upon the combing machine mentioned above in such a way that it is possible to carry out a lap roll change automatically, and also simultaneously on some or all of the combing heads of the machine.

In the combing machine of the invention, each combing head includes a device for severing the first lap sliver unrolled from said first lap roll and running to said front carrier device, in order to form a definite end of this lap sliver in a specified location, and that a commonly assigned control unit is provided for at least some of the combing heads for the control of said severing devices and of said conveying devices of these combing heads so that the conveying devices place new lap rolls on the front carrier devices at such a point in time that the starts of the lap slivers on these new lap rolls are aligned with the lap sliver ends formed by said severing devices and running to the front carrier devices.

The control unit can expediently also control devices for the removal of empty or nearly empty winding tubes from the rear carrie devices, and devices for rolling the second lap rolls from the front to the rear carrier devices.

BRIEF DESCRIPTION OF THE DRAWINGS

An embodiment of the combing machine according to the invention will now be described in greater detail with reference to the accompanying drawings in which.

DETAILED DESCRIPTION OF THE PREFERRED EMBODIMENTS

Figure 1:
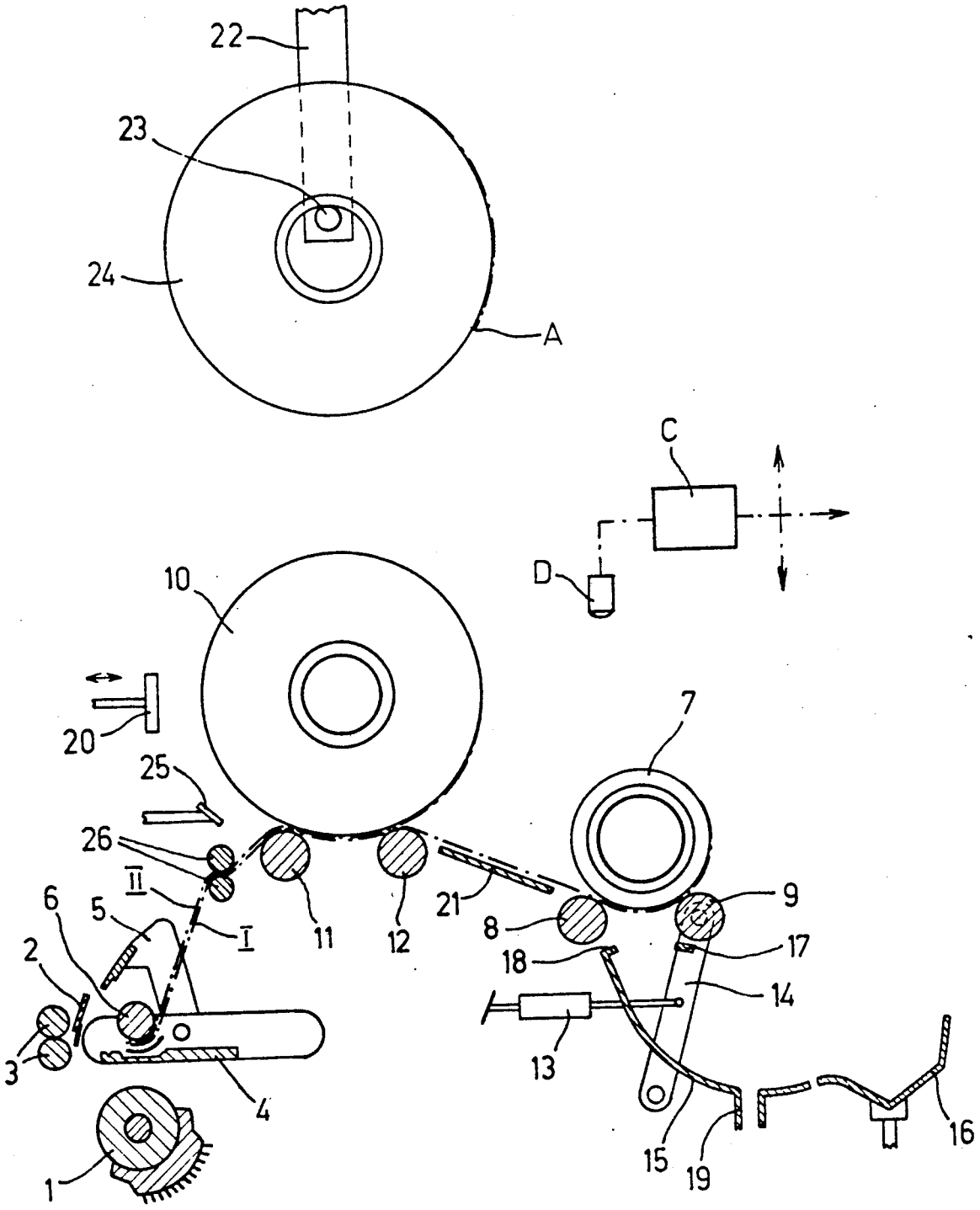
FIG. 1 is a schematic vertical section of parts of a combing head of a combing machine and FIGS. 2 to 9 each show, at a smaller scale, a similar view as FIG. 1, with different positions of parts of the combing head.

The essential combing tools of the combing head schematically shown in FIG. 1 are a comb cylinder 1, a top comb 2, two detaching rollers 3 and a jaw nipper unit with a lower jaw 4 and an upper jaw 5 which swivels with reference to the lower jar. An intermittently driven feed roller 6 is supported in the lower jaw 4.

Two lap slivers I and II lying one on top of the other are fed in parallel to the feed roller 6. The lap sliver I is unrolled form a first lap roll 7, which is supported on a rear carrier device. The rear carrier device consists of two parallel lap rollers 8 and 9, at least one of which can be driven. The lap sliver II is unrolled from a second lap roll 10 which is supported on a front carrier device. The front carrier device again consists of two lap rollers 11 and 12, which are parallel to each other and to the lap rollers 8 and 9. At least one of the lap rollers 11 and 12 can be driven. Thereby, the first lap sliver I runs over the front carrier device, that is, over the lap rollers 11 and 12, and the second lap roll 10 lies on the first lap sliver I over the front carrier device.

The combing machine includes a plurality of, for example eight, combing heads of the type described, arranged in a row. When the lap sliver I is at least nearly completely unwound from the first lap roll 7 in one of the combing heads of the machine, then a lap roll change is carried out automatically and without stopping the machine. This lap roll change is carried out simultaneously on all of the combing heads of the machine, or at least on a group of the combing heads, for instance, on four combing heads.

Figure 2:
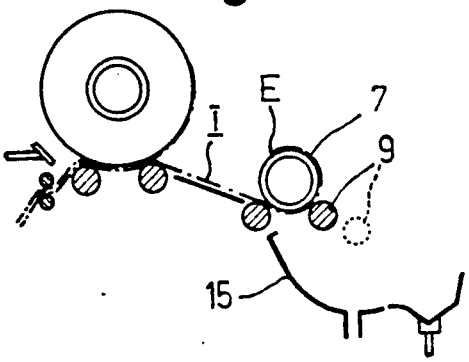

Each combing head contains a detector D for this purpose, which determines the point in time represented in FIG. 2, at which the end, i.e., a trailing end, E of the first lap sliver I appears on the winding tube of the first lap roll 7. This detector D can be a photo-electric ell, for example, which detects the difference between the lighter colored lap sliver and the darker colored winding tube of the lap roll 7. The detector D transmits a signal which actuates a program control unit C which then simultaneously carries out the process described in the following paragraphs with all combing heads of the machine or at least with a group of the combing heads.

Figure 3:
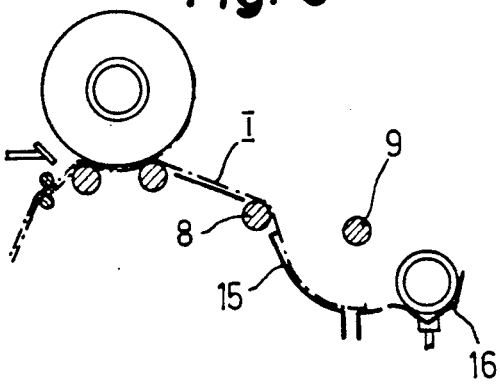

Firstly, a device is actuated for the removal of the empty or nearly empty winding tube of the first lap roll 7 from the rear carrier device 8, 9. This removing device includes, for example, a device for displacing the rear lap roller 9 into the position indicated with a dash-dotted line in FIG. 2, such as a device 13 (FIG. 1) for swivelling the arms 14 carrying the rear lap roller 9. Through this displacement, the distance between the lap rollers 8 and 9 is increased so far that the empty or nearly empty tubes fall down between the lap rollers 8 and 9. Below the lap rollers 8 and 9, there is a guide 15 on which the winding tube then rolls towards the rear. Thereby, the remainder of the lap sliver on the winding tube, which naturally will have slightly different lengths in the various combing heads unwinds and remains on the guide 15. The empty winding tube rolls on to a collecting shell 16, as shown in FIG. 3.

Figure 4:
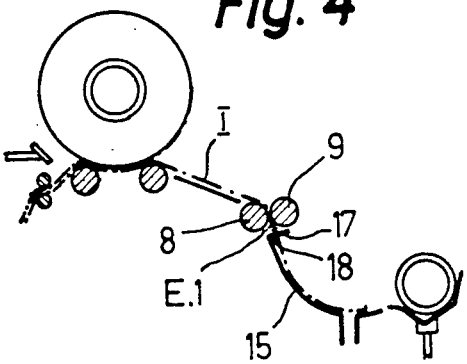

Then a device is actuated in each combing head for severing the lap sliver I at a predetermined location. Therewith, the different lengths of lap sliver residues lying on the guides 15 in the various combing heads are separated, and a definite end of the lap sliver I is formed, which lies at the same specified location in all the combing heads. The severing device can, for example, include means for pressing the lap sliver I on to the driven lap roller 8, so that this continues to move the lap sliver I, and means for clamping the lap sliver I directly behind the lap roller 8, so that the lap sliver breaks here. The means for pressing the lap sliver I on to the lap roll 8 can contain means for moving the lap roller 9, as shown in FIG. 4, against the lap roller 8, namely, the device 13 (FIG. 1) already mentioned, with the swivel arms 14. The swivel arms 14 can also carry a jaw rail 17 which cooperates with a stationary jaw 18, for example fitted on the guide 15, in order to clamp the lap sliver I behind the lap roller 8. The lap sliver I, which is moved further by the lap rollers 8 and 9, then breaks between these rollers and the jaw rails 17, 18, and a new, definite end E.1 of the lap sliver I results.

If the lap roller 9 has been displaced for the severing of the lap sliver I as described, then this roller 9 is subsequently returned to its starting position, and the jaw 17, 18 is opened.

Figure 5:
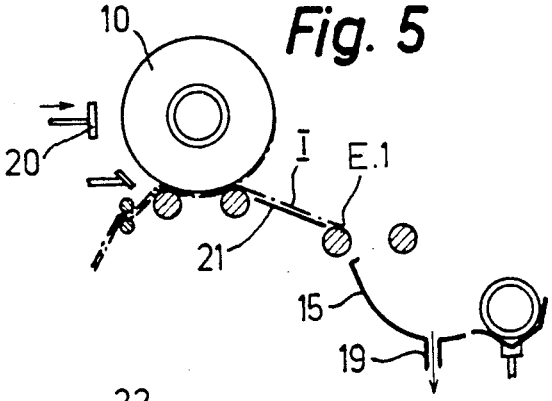

Then a device is actuated for the removal of the separated rear end piece of the lap sliver I from the guide 15. This device may include, for instance, a suction channel 19 which merges into the guide 15 and in which a suction is now produced, as indicated in FIG. 5.

Figure 6:
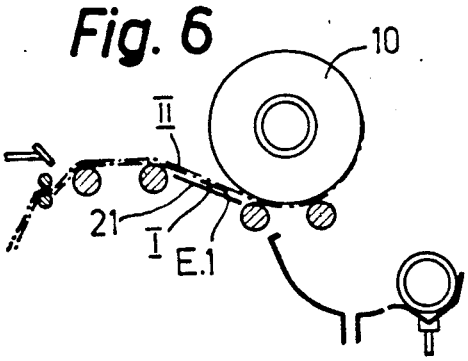

Further, a device is actuated which brings the second lap roll 10 from the front carrier device 11, 12 to the back on to the rear carrier device 8, 9. This device includes, for example, a ram 20 which pushes the lap roll 10 to the rear, so that this lap roll 10 rolls back on the lap sliver I (supported by a guide 31) into the position shown in FIG. 6.

Figure 7:
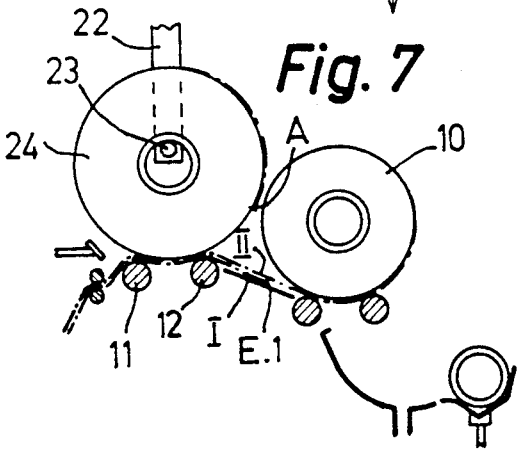

A conveying device is assigned to each combing head for placing new lap rolls on the front carrier device 11, 12. Of this conveying device, only a carrier arm 22 with a spigot 23 has been represented in FIGS. 1 and 7. The conveying device 22, 23 is now actuated in order to place a new lap roll 24 on the lap slivers I and II which run over the lap rollers 11 and 12 of the front carrier device. The start, i.e., the forward end, A of the lap sliver on the new lap roll 24 is so positioned on the periphery of this lap roll that this start A, at the point in time of placing the lap roll 24 on the front carrier device, is the same distance away from the lap roller 12 as the end E.1 of the first lap sliver I. As the new roll 24, after the placing on the lap rollers 11, 12, is rotated on the lap rollers 11, 12, the start A and the end E.1 reach the lap roller 12 at the same time, that is, the start A and the end E.1 are aligned with each other.

Figure 8:
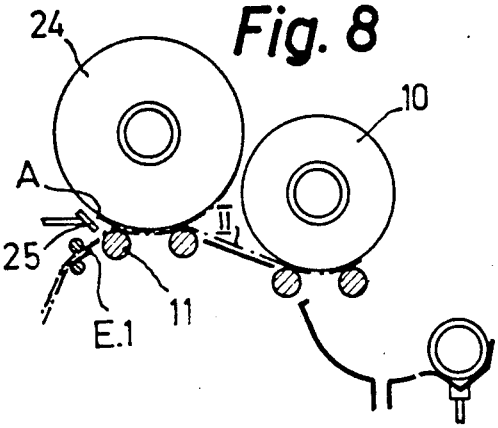
Figure 9:
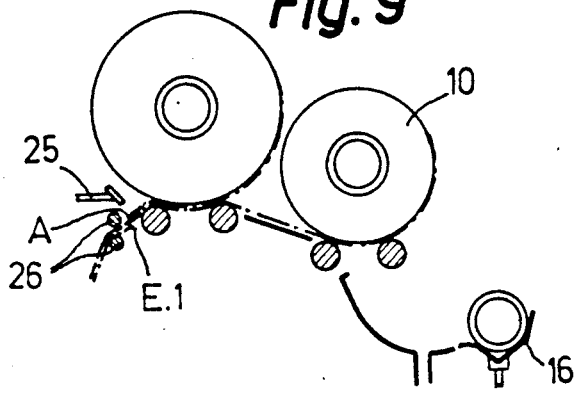

FIG. 8 shows a condition which an occur after the start A and the end E.1 have left the lap roller 11. The start A possibly adheres to the periphery of the new lap roll 24. For this reason, a stripping device for releasing the start A from the periphery of the lap roll 24 is actuated. The stripping device comprises a suction nozzle 25, for instance, which is moved towards the periphery of the lap roll 24, in order to release the start A. Subsequently, the suction nozzle 25 is retracted and the underpressure is shut off, so that the start A, as shown in FIG. 9, lies against the lap sliver II coming from the lap roll 10. A suction roller or a mechanical element could, of course, be used in place of the suction nozzle 25 for releasing the start A from the periphery of the new lap roll 24 and laying it on the lap sliver II.

The start A of the lap sliver from the new lap roll 24, lying on the lap sliver II, then runs together with the lap sliver II through a pair of calender rollers 26, which press the start A on the lap sliver II.

It can be seen that, in the combing machine described, two lap slivers lying one on top of the other are continuously fed to the feed roller 6 of every combing head. As in the lap roll change, which is carried out automatically and with the machine running, the start A from the new lap roll 24 is aligned with the end E.1 of the lap sliver I from the first lap roll 7, neither a place with a thickening nor with reduced thickness results at the transition.

The empty winding tube from the original first lap roll 7 still lies on the collecting shell 16 in FIG. 9. This winding tube is returned to the conveying device at a suitable point in time or is taken over by this, under the control by the control unit C.

It will thus be seen that the program control unit C, which is commonly assigned to a group of the combing heads of the combing machine or to all the combing heads of the machine, and is adapted to receive signals from the detectors D of all the combing heads of the group or of the machine, respectively, controls the automatic execution of a simultaneous lap roll change in all the combing heads of the group or of the machine, respectively. In these combing heads the control unit C actuates in the described manner the various devices which effect the lap roll change.

What is claimed is:

1. A combing machine having a plurality of combing heads, each combing head including a rear carrier device for a first lap roll, with at least one first lap roller which can be driven, and a front carrier device for a second lap roll, with at least one second lap roller which can be driven, and each combing head having associated therewith a conveying device for placing lap rolls on said front carrier device, wherein each combing head includes a device for severing a first lap sliver unrolled from said first lap roll and extending to said front carrier device, forming a definite end of said first lap sliver at a predetermined location, and wherein a commonly assigned control unit is provided for at least some of the combing heads for the control of said severing devices and of said conveying devices of said combing heads so that said conveying devices place new lap rolls on said front carrier devices at such a point in time that respective forward ends of lap slivers on said new lap rolls are aligned with respective ones of said lap sliver definite ends formed by said severing devices and extending to said front carrier devices.

2. A combing machine as claimed in claim 1, wherein each combing head includes a detector for detecting a trailing end of the lap sliver running out from said first lap roll and for transmission of a starting signal to the control unit assigned.

3. A combing machine as claimed in claim 1, wherein each combing head includes a device for removal of empty or nearly empty winding tubes from said rear carrier device.

4. A combing machine as claimed in claim 3, wherein said device for the removal of winding tubes is arranged to be controlled by said control unit respectively assigned to the combing head.

5. A combing machine as claimed in claim 3 wherein each combing head includes a device which is operable to roll said second lap roll from said front carrier device to said rear carrier device.

6. A combing machine as claimed in claim 5, wherein said device operable to roll said second lap roll is operable by said control unit assigned to the respective combing head.

7. A combing machine as claimed in claim 3, wherein said device for the removal of winding tubes includes a guide and means for rolling the winding tubes to the rear on said guide.

8. A combing machine as claimed in claim 7, wherein said rear carrier device includes two lap rollers and wherein said means for rolling the winding tubes to the rear include means for temporarily increasing the distance between said two lap rollers of said rear carrier device.

9. A combing machine as claimed in claim 7, wherein said severing device comprises means for severing the first lap sliver over said guide after a winding tube is rolled to a rear portion of the guide.

10. A combing machine as claimed in claim 9, wherein said severing device includes means for pressing the first lap sliver on to said driven first lap roller of said rear carrier device, and means for clamping the first lap sliver behind said driven first lap roller.

11. A combing machine as claimed in claim 9, wherein each combing head includes means for the removal of cut off end pieces of the first lap sliver from said guide.

12. A combing machine as claimed in claim 1, further comprising means, positioned in each combing head in front of said front carrier device, for stripping the forward end of the lap sliver from a new lap roll placed on said front carrier device, and for placing said forward end on the lap sliver coming from the rear carrier device.

13. A combing machine as claimed in claim 1, further comprising, in each combing head in front of said front carrier device, calendar rollers for pressing together the two lap slivers coming from the front carrier device.

* * * * *